US005361433A

United States Patent [19]

Vanzant

[11] Patent Number: 5,361,433

[45] Date of Patent: Nov. 8, 1994

[54] PNEUMATIC SIT/STAND ASSISTANCE DEVICE UTILIZING SEQUENTIAL INFLATION FOR STABILIZING EFFECTS

[76] Inventor: B. W. Vanzant, 7743 Pimlico, Boerne, Tex. 78006

[21] Appl. No.: 65,561

[22] Filed: May 21, 1993

[51] Int. Cl.[5] ..... A47C 7/00

[52] U.S. Cl. ..... 5/81.1; 5/654; 254/93 HP; 297/DIG. 3; 297/DIG. 10

[58] Field of Search ..... 5/81.1, 654, 453, 454, 5/455, 450; 297/DIG. 10, 485, DIG. 3; 254/93 HP

[56] References Cited

U.S. PATENT DOCUMENTS

| | | | |
|---|---|---|---|
| 3,192,540 | 7/1965 | Swank | 5/654 |
| 3,479,087 | 11/1969 | Burke | 297/DIG. 10 |
| 3,721,232 | 3/1973 | Trenchard | 5/654 |
| 4,592,589 | 6/1986 | Hellwig | 5/654 |
| 4,629,162 | 12/1986 | Porche | 254/93 HP |
| 4,905,329 | 3/1990 | Heilner | 5/654 |
| 5,079,785 | 1/1992 | Garcia | 5/654 |

*Primary Examiner*—Alexander Grosz
*Attorney, Agent, or Firm*—Gambrell, Wilson & Hamilton

[57] ABSTRACT

A pneumatic sit/stand device which is preferably used in assisting an invalid or physically disadvantaged person in rising from, or being seated in, a chair. The sit/stand device includes an inflatable bag having two or more cavities which inflate sequentially to help stabilize the person as he is raised from or lowered into a chair. Rear and side wall cavities inflate first to provide stabilization and push the person forward so that his feet contact the floor. A center cavity then inflates to lift and thrust the person into a standing position. The side walls help prevent the person from tilting or leaning from one side to another as air pressure equalizes the bag. The device can be used alone by the physically disadvantaged person or in conjunction with an attendant whose duty is to assist the person in sitting or standing.

19 Claims, 4 Drawing Sheets

PNEUMATIC SIT/STAND ASSISTANCE DEVICE UTILIZING SEQUENTIAL INFLATION FOR STABILIZING EFFECTS

SPECIFICATION

1. Field of the Invention

The present invention relates generally to an apparatus for use in assisting an invalid or physically disadvantaged person in moving to or from a seated position, and more specifically to a pneumatic sit/stand device using an inflatable bag having cavities which inflate sequentially to provide a stabilizing effect.

2. Description of the Related Art

Elderly, invalid, and otherwise physically disadvantaged persons often encounter difficulty in raising themselves from or lowering themselves into a chair. The problem of arising from or sitting in a chair is particularly acute with elderly, invalid or obese persons having weakened arm muscles, and assistance is often required to permit them to rise or sit down. In many instances, the cumulative effect is to bruise the arms of the person being assisted in addition to causing physical and mental discomfort to the person assisting, if such person is available. In cases where no personal assistance is available, mechanical, hydraulic or pneumatic sit/stand devices have been developed. In general, these devices are heavy, and once positioned remain stationary.

One type of sit/stand device uses an inflatable bag to raise or lower the person. The inflatable bag type of sit/stand device is particularly advantageous in that it is lightweight, and may be simply constructed of durable, inexpensive materials. Thus, an inflatable bag may be conveniently transported and placed in a chair to help lift a person from the chair. For example, U.S. Pat. No, 3,346,885, issued Oct. 17, 1967 to Merriman describes an inflatable bag used to raise or lower a person from a bathtub.

U.S. Pat. No. 4,629,162 to Porche discloses an inflatable bag apparatus for enabling an invalid or physically handicapped person to rise from or lower into a chair. This lift uses a bag that is wedge-shaped so that inflation of the bag lifts and thrusts the person forward. However, a limitation of this device and method is that the entire bag is inflated at one time, and nothing is provided to stabilize the person and prevent the person from falling to either side. As the person is lifted out of the chair, nothing is provided to ensure that the person does not tilt backwards or lean to one side as air pressure equalizes the bag. In addition, the person is lifted upward prior to being pushed forward to an extent where his feet touch the ground. If the person being lifted is unsteady or lacking in balance, the person may fall to one side or the other, possibly with accompanying injury, Therefore, an improved sit/stand device is desired which stabilizes the person as the person is being raised from or lowered into a chair.

SUMMARY OF THE INVENTION

The present invention comprises a pneumatic sit/-stand device which is preferably used in assisting an invalid or physically disadvantaged person in rising from, or being seated in, a chair. The sit/stand device of the present invention comprises an inflatable bag which has an improved design to provide thrusting and lifting forces sequentially in order to help prevent the person from tilting or leaning from one side to another as air pressure equalizes the bag.

In a first embodiment comprising two internal cavities, the sit/stand device includes a center cavity where the person is seated and an outer cavity. The outer cavity is comprised of side wall portions on either side of the center cavity and a rear portion that provides back support to the person being seated or lifted. An air supply assembly is included comprising an air inlet, tubes, inner partitions, and orifices. The inner partitions are included in the device to form the outside and center cavities. The inlet receives air from a source, and the tubes, partitions, and orifices distribute this air to the outer cavity and then to the center cavity. As the bag is inflated, the side wall portions of the outer cavity inflate to provide sideways stability; the rear portion of the outer cavity provides a thrusting force outward (or forward) which also aids the person in standing; while the center cavity provides a lifting force which helps the person stand. This combination of lifting and thrusting better enables a person to rise from or lower into a chair.

Inner partitions having orifices are configured to form the outer and center cavities and distribute the air from the outer cavity to the center cavity. In this embodiment, a first interior partition divides the rear portion of the outer cavity from the center cavity, and second and third interior partitions divide the side wall portions of the outer cavity from the center cavity. The second and third inner partitions each have an orifice between the respective side wall portion of the outer cavity and the center cavity. Air flow is unrestricted between the rear and side wall portions of the outer cavity, and the orifices allow restricted air flow between the outer cavity and the center cavity. Thus, as the device is inflated, the air flows from the side wall portions of the outer cavity to the center cavity, inflating the rear and side wall portions of the outer cavity before the center cavity is inflated. This sequential inflation provides a stabilizing effect.

Alternatively, in an arrangement having four internal cavities, the device is configured having a rear cavity, side wall cavities, and a center cavity. The air supply assembly directs air first to the rear cavity, then to the side wall cavities and finally to the center cavity. This causes the device to inflate generally according to the sequence: rear cavity, side wall cavities, center cavity. In this manner, the rear and side wall cavities inflate first to provide stability to the person before the majority of the center cavity has been inflated, i.e. before a majority of the lifting force has been applied. Another embodiment includes open cell foam pads placed in the outer cavity to provide additional lifting force in addition to decreasing the volume of air needed.

BRIEF DESCRIPTION OF THE DRAWINGS

A better understanding of the present invention can be obtained when the following detailed description of the preferred embodiment is considered in conjunction with the following drawings, in which.

DETAILED DESCRIPTION OF THE PREFERRED EMBODIMENT

Figure 1:
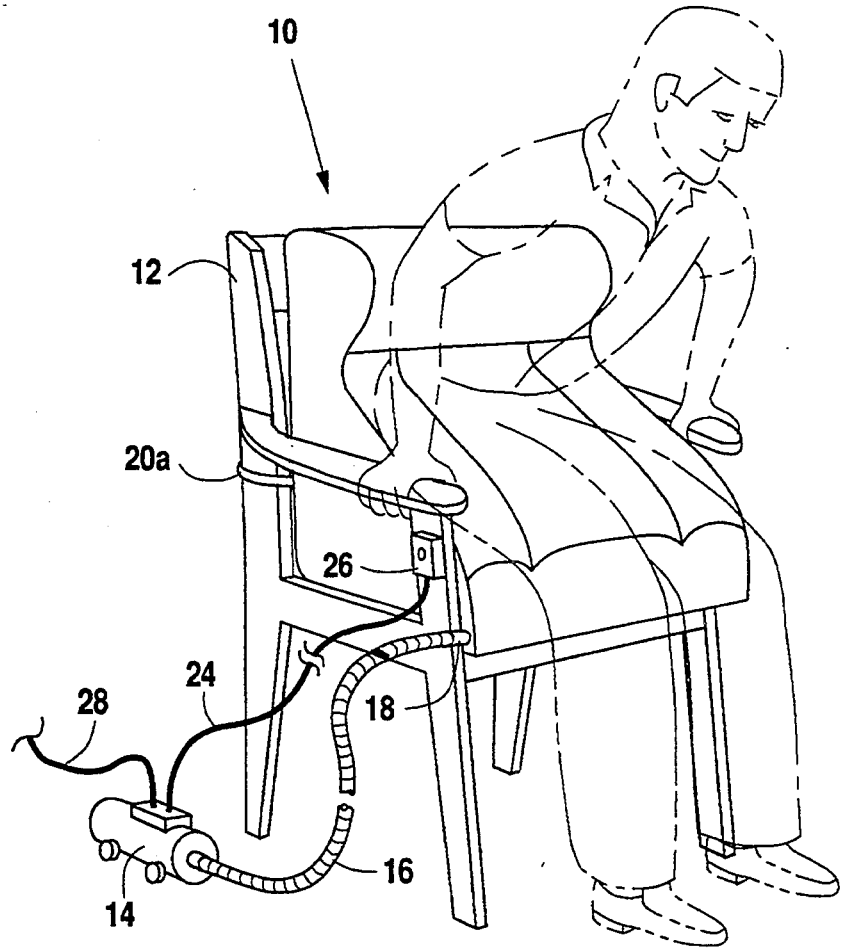
FIG. 1 depicts the sit/stand device of the present invention being used to help a person stand up from a chair.

Referring to FIG. 1, the sit/stand device 10 of the present invention is shown being used to lift a person out of a chair 12. It is noted that the sit/stand device 10 of the present invention can be used to either lift a person from a chair or lower a person into a chair. In the following description, the sit/stand device 10 is primarily described as being used in raising a person from a chair. The sit/stand device 10 is intended for elderly, handicapped, obese, invalid or otherwise physically disadvantaged persons who encounter difficulty in rising from or lowering themselves into a chair. The sit/stand device 10 can also be used by people who assist such disadvantaged persons by pulling under their arms, pushing on their backs, etc.

The sit/stand device 10 rests on the seat of the chair 12 and against the back of the chair 12 and is secured to the back of the chair 12 with two straps 20*a* and 20*b* (strap 20*b* not shown). The sit/stand device 10 includes an air supply assembly which includes an air inlet 18 located on the side of the sit/stand device 10 toward the front and below the sitting surface of the chair 12. The air inlet 18 is coupled to an air supply 14 via a hose 16. The air supply 14 is preferably a standard type air inflation device. The air supply 14 also includes a cord 24 connected to a power button 26 on the chair 12 and another cord 28 connected to an electrical outlet (not shown). The power button 26 is used to energize the air supply 14 and is preferably placed near an arm of the chair 12 for ready access by a person in the chair 12.

Figure 2:
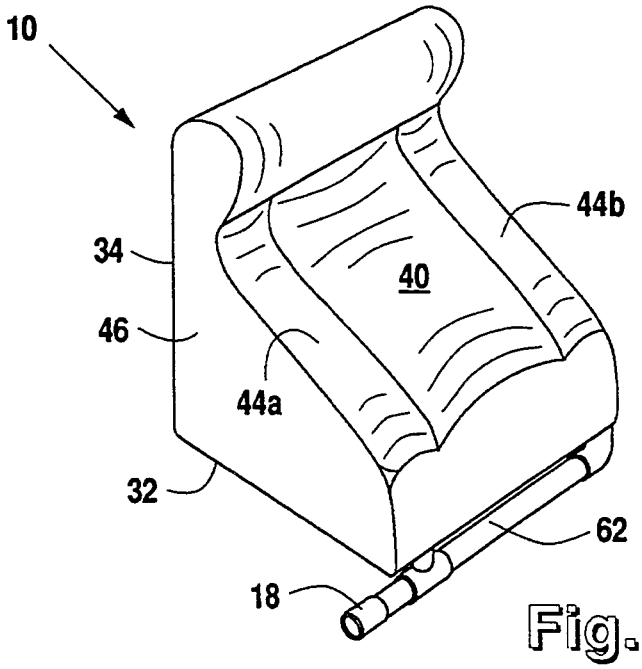
FIG. 2 illustrates the sit/stand device fully inflated.

With reference to FIG. 2, the sit/stand device 10 is shown by itself and inflated. In one embodiment, the device 10 has a manifold 62 which hangs over the edge of the chair 12 (FIG. 1) when the bottom 32 of the device 10 is placed in the chair seat and the back 34 of the device 10 is placed against the chair back. The manifold 62 is used to distribute incoming air from inlet 18 at an equal rate into both side wall cavities 44*a* and 44*b*. In addition to providing air into the device 10, as discussed below, the manifold 62 is provided on the front of the device 10 to position the device 10 relative to the front of the chair 12 as well as ensure that the device 10 is spread across the chair 12 when the device 10 is first placed in the chair 12. This prevents the device 10 from beginning an initial cycle at an improper position in the chair. Also the manifold 62, along with the straps 20*a* and 20*b* (FIG. 1), help to ensure that the device remains in a functional, inflatable position on the chair 12 during sustained use.

Figure 3:
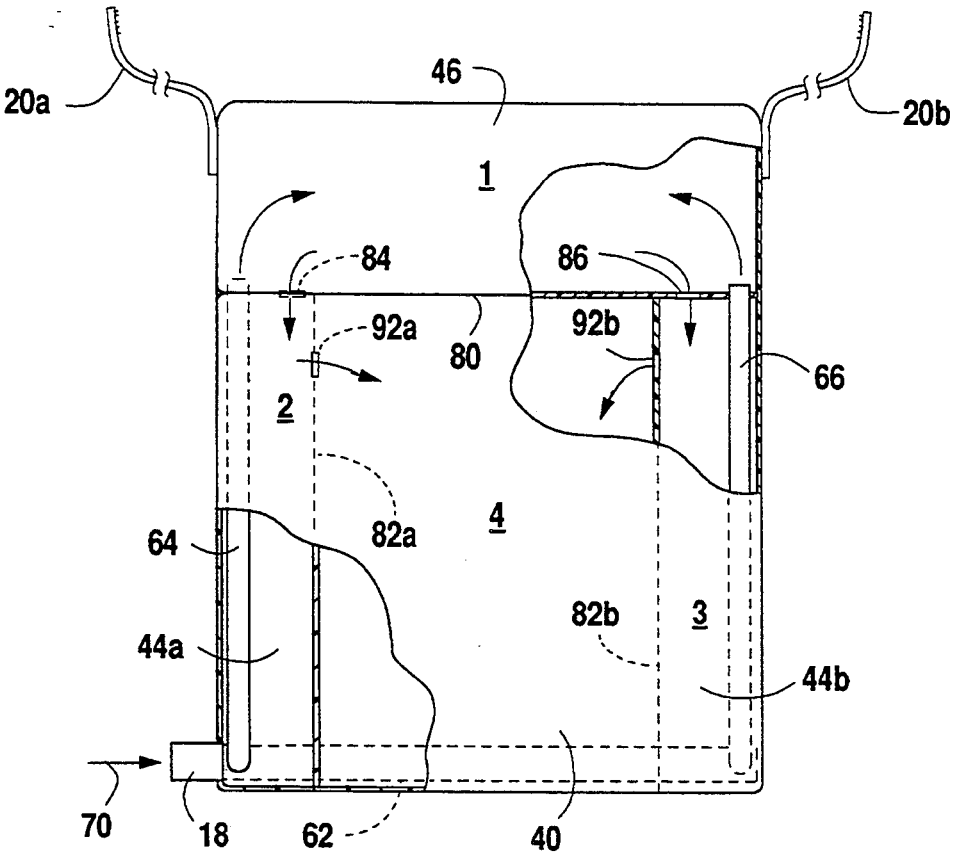
FIG. 3 is a top view of the sit/stand device illustrating air flow according to one embodiment of the invention.
Figure 4:
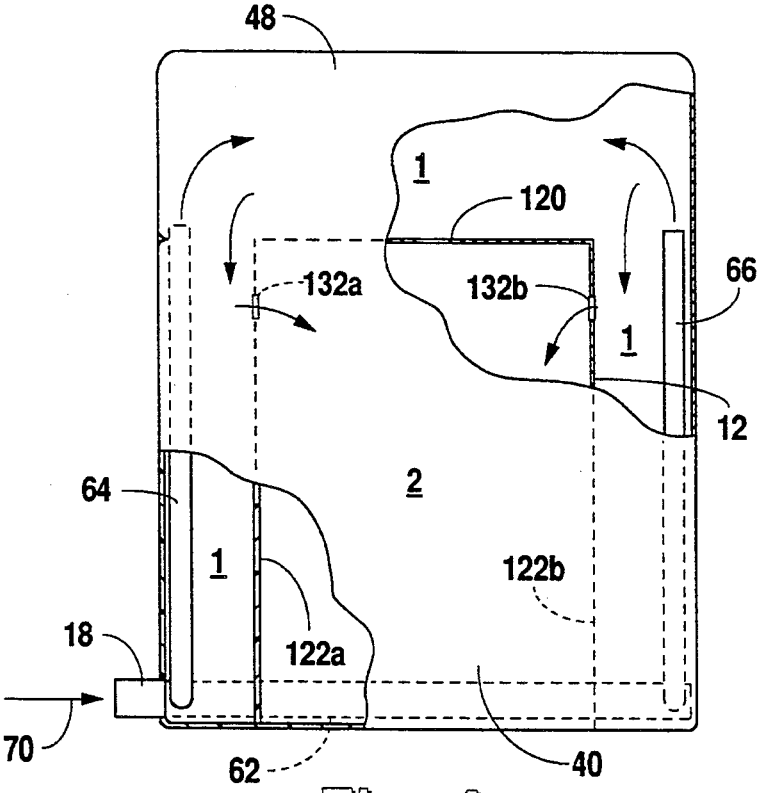
FIG. 4 is a top view of the sit/stand device illustrating air flow according to the preferred embodiment of the invention.

The sit/stand device 10 comprises an inflatable bag that is partitioned into separate cavities. The number and arrangement of the various cavities are discussed below with regard to FIGS. 3 and 4. In a four cavity embodiment, as shown in FIG. 3, the device 10 includes a center cavity 40, side wall cavities 44*a* and 44*b*, and a rear cavity 46. In the preferred embodiment, which has two internal cavities, the rear and side wall portions comprise a single outside cavity which is separate from the center cavity 40, as shown in FIG. 4. As described below, these cavities inflate sequentially to provide stabilization and support as the person is being raised from, or lowered into, a chair. The inflatable bag is preferably made of Regency 70 Denier Nylon.

Referring again to FIGS. 3 and 4, top views of the sit/stand device illustrating the internal components and air distribution according to two different embodiments are shown. In each embodiment, various inner partitions are arranged in the bag to form the cavities. The air inlet 18, tubes and various inner partitions having orifices, which form the air supply assembly, distribute air according to a predetermined sequence.

Air distribution in the bag is preferably such that a person using the device is stable and does not tilt or lean from side to side (wobble) as air pressure equalizes in the bag. Thus, air enters on both sides to provide level rising characteristics. The rear and side wall portions of the bag preferably fill first to provide firmness and stability around the person's buttocks and legs. To accomplish this, the center cavity may be an island with outer cavities(y) completely surrounding it (not shown), or it may be a peninsula extending inward from the front of the bag as illustrated in FIGS. 3 and 4. It may also be desirable to have the center cavity shaped as a pocket, but it must rise sufficiently to push the user up to about 20°–30° from the vertical so that he will be able to lean forward and stand. It is important that the person provide his own impetus to achieve a standing position.

Referring now to the four cavity embodiment in FIG. 3, the device 10 includes an air supply assembly which in this embodiment includes the external inlet 18, external manifold 62, and internal tubes 64 and 66 which direct air 70 to the rear cavity 46 of the device 10. The rear cavity 46 is divided from the center cavity 40 and the side wall cavities 44*a* and 44*b* by an inner partition 80. Each side wall cavity 44*a* and 44*b* is divided from the center cavity 40 by respective inner partitions 82*a* and 82*b*. Inner partition 80 has first and second orifices 84 and 86 between the rear cavity 46 and the side wall cavities 44*a* and 44*b*. Inner partitions 82*a* and 82*b* each have an orifice 92*a* and 92*b* between the side wall cavities 44*a* and 44*b* and center cavity 40. In this embodiment, the orifices 92*a* and 92*b* are located toward the rear of the side wall cavities 44*a* and 44*b*. Alternatively, the orifices can be moved closer to the front of the side wall cavities 44*a* and 44*b* to alter the inflation of the side wall cavities 44*a* and 44*b* relative to the rear cavity 46. The inner partitions 80, 82*a* and 82*b* are preferably made of the same material as the outer material of the bag comprising the device 10.

The rear cavity 46, side wall cavities 44*a* and 44*b*, and center cavity 40 are labeled 1 through 4, respectively as shown in FIG. 3, and the device inflates generally according to the sequence 1→2,3→4. The tubes 64 and 66 provide the air directly to the rear cavity 46, and thus the rear cavity 46 begins to inflate first. The side wall cavities 44*a* and 44*b*, labeled 2 and 3, begin to inflate soon after the rear cavity 46 begins to inflate. The side wall cavities 44*a* and 44*b* inflate virtually simultaneously. Finally, the center cavity 40 begins to inflate.

FIG. 4 is a top view of the sit/stand device depicting an alternative and preferred arrangement of the air bag. This embodiment comprises an outer cavity 48 including rear and side wall portions and a center cavity 40 forming the center section. As in the previously described embodiment, the device 10 depicted here has an air supply assembly which includes the external inlet 18, external manifold 62 and internal tubes 64 and 66 which direct air 70 to the rear of the device 10. The rear portion of the outer cavity 48 is divided from the center cavity 40 by an inner partition 120. The side wall portions of the outer cavity 48 are divided from the center cavity 40 by inner partitions 122*a* and 122*b* which are in reality extensions of inner partition 120. Center or inner cavity 40 is defined by the inner partitions 120, 122*a* and 122*b*. Inner partitions 122*a* and 122*b* each have an orifice 132*a* and 132*b*, respectively, between the side wall portions of the outer cavity 48 and the center cavity 40. The two orifices 132*a* and 132*b* in FIG. 4 correspond to the orifices 92*a* and 92*b* in FIG. 3.

FIG. 4 also shows details of the air flow path during inflation of the device in this embodiment. Air 70 enters the air supply assembly inlet 18 and is directed through the external manifold 62 and inner tubes 64 and 66 into the rear portion of outer cavity 48. The air then passes through the orifices 132*a* and 132*b* into the center cavity 40. The outer cavity 48 and center cavity 40 are labeled 1 and 2, respectively, and the device 10 inflates according to the sequence 1→2. The person sitting on top of the center cavity 40 helps ensure that the outer cavity 48, rear portion and both side wall portions inflate first.

Figure 6A:
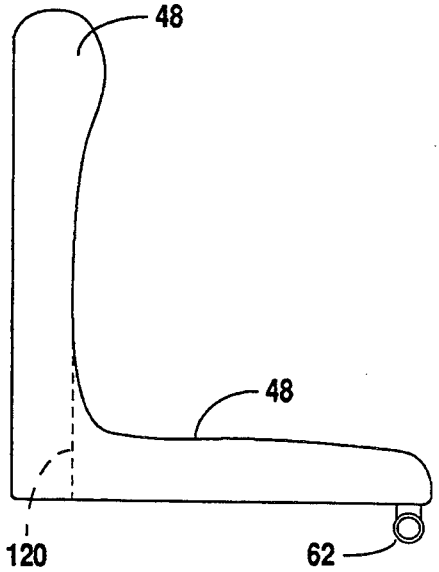
FIGS. 6*a*–6*d* are perspective views of the sit/stand device alone in various stages of inflation.
Figure 6B:
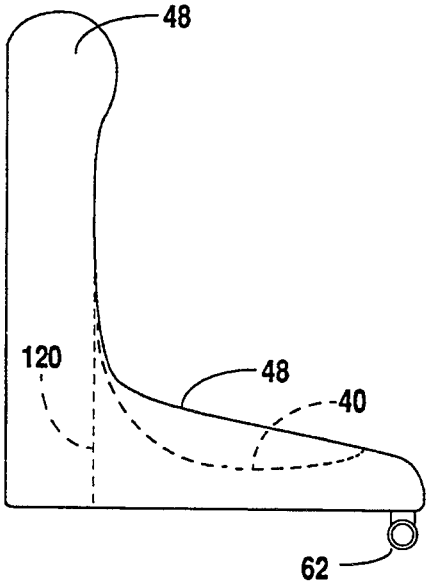

FIGS. 6*a*–6*d* illustrate inflation of the device 10 according to the embodiment of FIG. 4. With reference to FIG. 6*a*, the sit/stand device 10 is shown by itself completely deflated. In FIG. 6*b*, the device is shown partly inflated. In the partly inflated condition, the side wall portions of the outer cavity 48 are more inflated than the center cavity 40. This tends to prevent a person (not shown) sitting on the center cavity 40 from moving sideways. Also, the upper rear portion of the outer cavity 48 is somewhat more inflated, which acts to push the person forward. The center cavity 40 is outlined by the dashed lines and inner partition 120.

Figure 6C:
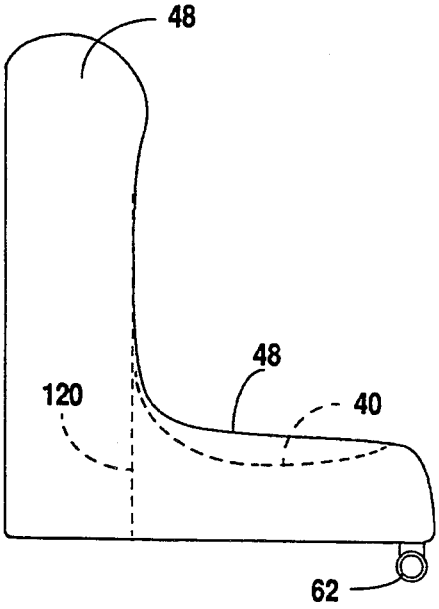

In FIG. 6*c*, the sit/stand device 10 is shown further inflated. In the further inflated condition, the rear portion of the outer cavity 48 is further inflated providing further forward thrusting of the person (not shown) sitting on the center cavity 40. The side wall portions of the outer cavity 48 are also further inflated. The center cavity 40 by now has begun to inflate to elevate the person from the chair 12. In this further inflated condition, the side wall portions prevent sideward movement of the person sitting on the center cavity 40, and lifting action pushes the person upward. Also, the contoured form of the center cavity 40 serves to push the persons forward to a standing position. Again, in FIG. 6*c*, the dashed lines indicate the form of the center cavity as defined by the top outside surface and the rear inner partition 120.

Figure 6D:
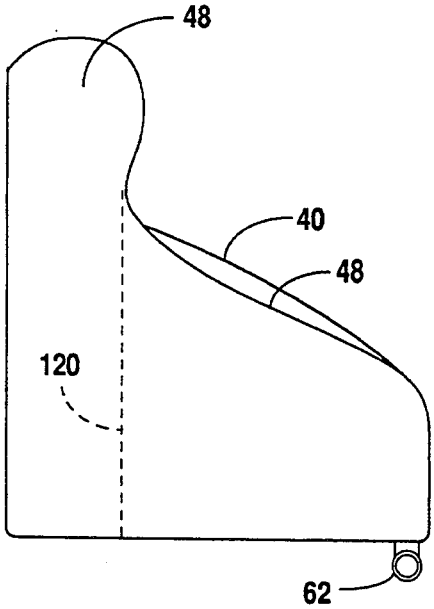

In the completely inflated state as shown in FIG. 6*d*, the upper rear portion of the outer cavity 48 has filled out the limits of its contour to form a convex shape with respect to the side wall portions. The center cavity 40 has fully inflated and is now above the previously inflated side wall portions of the outer cavity 48. In this state, the side wall portions are no longer above the center cavity 40 to restrain sidewards movement of a person (not shown) on the center cavity 40. Also the center cavity 40 has inflated such that the rear of the center cavity 40 is now substantially higher than the front. This is due to the contour of the center cavity 40. Because the rear is above the front at this stage of inflation, additional forward thrusting is provided by the center cavity 40 in addition to its lifting action.

Figure 5A:
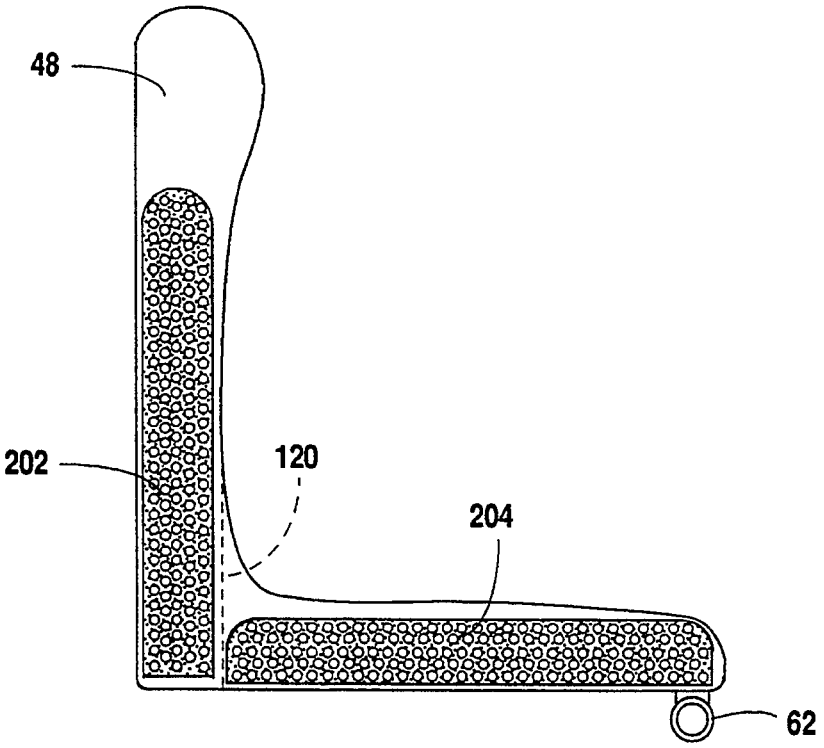
FIGS. 5*a* and 5*b* are a side view of the sit/stand device illustrating an alternative embodiment utilizing open cell foam pads.
Figure 5B:
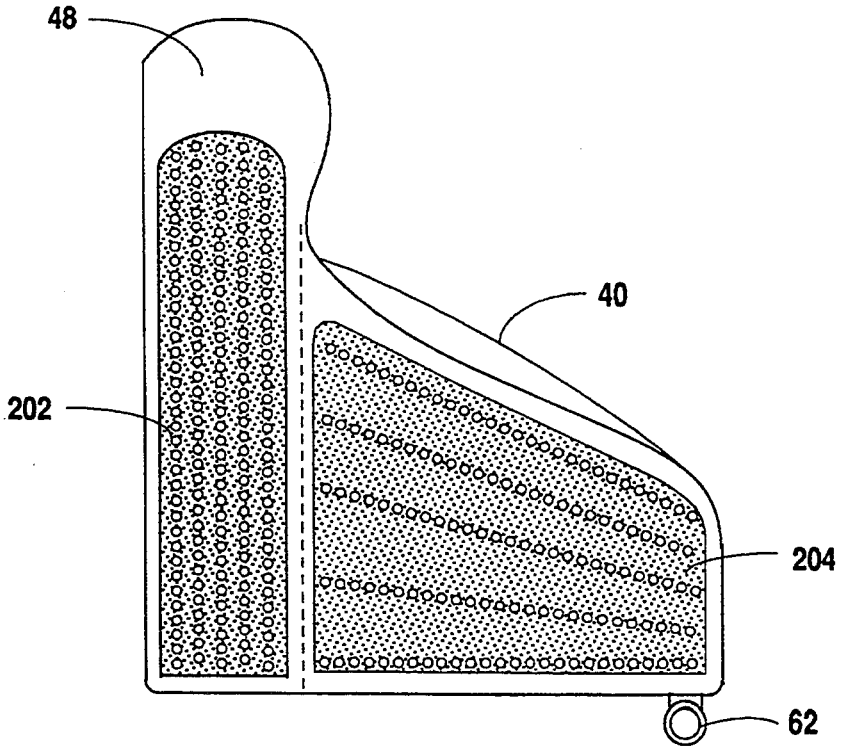

Referring now to FIGS. 5*a* and 5*b*, in an alternate embodiment the sit/stand device 10 includes open cell foam pads 202 and 204 in the outside cavity 48. The use of such internal material provides additional lifting force in addition to decreasing the volume of air needed for full inflation. This not only allows for lower volume of air, but also for lower pressures. Additionally, use of the open cell foam 202 and 204 in the rear and side portions of the external cavity 48 improves stability. FIG. 5*a* shows the device 10 in a collapsed state while FIG. 5*b* shows the device 10 in an inflated state.

In each of the above embodiments, to ensure that the user leans forward when using the device 10 to stand, the rear of the device 10 pushes the person forward somewhere close to the shoulder blades before beginning to lift him. For this reason, the device 10 begins to fill from the rear. This pushes the person forward to where his feet are touching the floor prior to any lifting force being applied. This provides further stability.

Thus, an improved sit/stand device is provided which provides stability to the person being lifted. The bag comprising the device is partitioned into two or more separate cavities which inflate sequentially. The rear and side walls of the device inflate first to bring the person's feet in contact with the floor and also prevent sideways movement. The center section begins inflation later after this stabilization has been provided to lift and thrust the person forward into a standing position.

The invention is intended to be limited only as defined in the claims. Additional objects, advantages, and novel features are set forth in the following description, or will be apparent to those skilled in the art or those practicing the invention. Other embodiments are within the spirit and scope of the invention. These objects and embodiments may be achieved by the combinations pointed out in the appended claims.

What is claimed:

1. An air operated inflatable, cushionlike sit/stand device for assisting physically disadvantaged persons in moving to or from a seated position, comprising:

a center cavity, wherein a person may be seated in the center cavity, and wherein the center cavity is capable of receiving air supplied thereto to lift the person upward a certain distance; and an outer cavity connected to said center cavity and capable of receiving air supplied thereto to stabilize the person as the person is lifted.

2. The sit/stand device of claim 1, further comprising:

an air supply assembly connected to said center and outer cavities which directs air to said outer cavity prior to directing air to said center cavity, wherein said outer cavity inflates generally prior to said center cavity to stabilize the person rising from a seated position.

3. The sit/stand device of claim 2, further comprising:

a partition separating said center cavity and said outer cavity, wherein said partition includes an orifice allowing passage of air between said center and outer cavities; and wherein said air supply directs air first to said outer cavity and said orifice distributes said air to said center cavity.

4. The sit/stand device according to claim 2, wherein the center cavity has front, rear, and opposite sides, and wherein the outer cavity comprises:

side wall portions located on each of the sides of the center cavity and capable of receiving air supplied thereto to retain the person within certain sideways limits of the center cavity during a portion of the lifting distance; and a rear portion connected to the rear of the center cavity and also connected to the side wall portions for supporting the person seated and capable of receiving air supplied thereto to thrust the person forward a certain distance.

5. The sit/stand device of claim 4, further comprising:

a first partition separating said rear portion and said center cavity, and second and third partitions separating said side wall portions and said center cavity;

wherein said first, second, and third partitions collectively include one or more orifices for distributing air between said center and outer cavities.

6. The sit/stand device of claim 1, further comprising an open cell foam pad comprised within said center cavity for providing additional lifting force and for decreasing the volume of air required for full inflation.

7. The sit/stand device of claim 1, further comprising an open cell foam pad comprised within said outer cavity for providing additional lifting force and for decreasing the volume of air required for full inflation.

8. The sit/stand device of claim 1, wherein said outer cavity thrusts the person forward while receiving air to allow the person's feet to touch the ground prior to the center cavity lifting the person upward.

9. The sit/stand device of claim 1, wherein the center cavity is capable of expelling air to lower a person a certain distance; and wherein the outer cavity is capable of expelling air to stabilize the person as the person is lowered.

10. The sit/stand device of claim 9, wherein said center cavity deflates prior to said outer cavity when a person is moving to a seated position to stabilize the person being seated.

11. An air operated sit/stand device for assisting physically disadvantaged persons in moving to or from a seated position, comprising:

a center cavity adapted to sit in the seat of a chair, wherein a person may be seated in the center cavity and wherein the center cavity is capable of receiving air supplied thereto to lift the person upward a certain distance;

a rear cavity connected to said center cavity and adapted to fit against the back of a chair and capable of receiving air supplied thereto for thrusting the person forward a certain distance;

side wall cavities connected to said rear cavity and connected to opposite sides of said center cavity and capable of receiving air supplied thereto to stabilize the person as the person is lifted.

12. The sit/stand device of claim 11, further comprising:

an air supply assembly coupled to said center, rear, and side wall cavities which directs air to said rear and side wall cavities prior to directing air to said center cavity, wherein said rear and side wall cavities inflate generally prior to said center cavity to stabilize the person rising from a seated position.

13. The sit/stand device of claim 11, further comprising:

a plurality of partitions separating said center, rear, and side wall cavities, wherein one or more of said partitions include an orifice allowing passage of air between said rear, side wall, and center cavities; and wherein said air supply assembly directs air first to said rear and side wall cavities and said orifice distributes said air to said center cavity.

14. The sit/stand device of claim 11, further comprising an open cell foam pad comprised within said center cavity for providing additional lifting force and for decreasing the volume of air required for full inflation.

15. The sit/stand device of claim 11, further comprising an open cell foam pad comprised within said rear cavity for providing additional stability and lifting force and for decreasing the volume of air required for full inflation.

16. An air operated sit/stand device comprising:

an inflatable bag adapted for a person to sit on having a plurality of cavities, and capable of receiving air supplied thereto for raising the person a certain distance;

an air supply assembly which provides air to sequentially to said cavities thereby retaining the person on the device and thrusting the person forward before lifting the person upward.

17. An air operated sit/stand device comprising:

an inflatable bag adapted to sit in the seat of a chair and capable of receiving air supplied thereto for raising a person seat in the chair a certain distance, wherein said inflatable bag includes a front which is positioned near the front of the chair and a rear which is positioned near the rear of the chair;

an air supply assembly which provides air sequentially to said inflatable bag; and a retainer connected to the front of the inflatable bag for positioning the front of the inflatable bag against the front of the chair wherein said retainer is a manifold which receives air from said air supply assembly and distributes said air to said inflatable bag.

18. The air operated sit/stand device of claim 17, wherein said retainer prevents movement of the inflatable bag in the chair.

19. The air operated sit/stand device of claim 17, wherein said retainer is rigid and maintains the inflatable bag properly spread across the front of the chair.

* * * * *